United States Patent [19]

Harrison

[11] 4,168,693

[45] Sep. 25, 1979

[54] PRE-OILING KIT FOR AN INTERNAL COMBUSTION ENGINE

[75] Inventor: Louis J. Harrison, Rutland, Vt.

[73] Assignee: Oilstart, Incorporated, Rutland, Vt.

[21] Appl. No.: 901,864

[22] Filed: May 1, 1978

[51] Int. Cl.[2] ..... F01M 1/00

[52] U.S. Cl. ..... 123/196 S; 123/198 D; 184/6.4

[58] Field of Search ..... 123/196 S, 198 D; 184/6.4

[56] References Cited

U.S. PATENT DOCUMENTS

| | | | |
|---|---|---|---|
| 1,926,801 | 9/1933 | Christian | 123/196 S |
| 2,102,514 | 12/1937 | Clarkson | 123/196 S |
| 2,110,662 | 3/1938 | Fisher | 123/196 S |
| 2,747,564 | 5/1956 | Wehling | 123/196 S |

*Primary Examiner*—Ronald H. Lazarus

*Attorney, Agent, or Firm*—Sughrue, Rothwell, Mion, Zinn and Macpeak

[57] ABSTRACT

A pre-oiling kit for an installation having a battery, an ignition switch, an internal combustion engine, an engine block and oil sump underlying the block, a port within the block leading to an oil gallery and a drain opening within the bottom of the sump, includes as a principal element of the kit; a container for mounting exterior of the block and housing a pre-oiler pump with an electric motor operatively coupled thereto, an oil pressure operated switch and an electrical relay. Two oil lines lead to the exterior of the container and are respectively connected to the inlet side of the pump through a strainer and from the outlet side of the pump through a check valve pressure switch and strainer. Four electrical lines extend from the kit container for respective connection to; the ignition switch for energization of the relay through the oil pressure operated switch, a dashboard booster button, a normally open switch for connection in parallel with the oil pressure operated switch for continued manual operation and control of the pump drive motor to increase pressure to the gallery if needed, a signal light indicating operation of the pre-oiling pump and through the normally open switch contacts of the relay to the electrical source for energization of the pump motor in response to relay operation. A Tee fitting and a replacement drain plug facilitate kit connection to the engine block and sump respectively.

4 Claims, 2 Drawing Figures

PRE-OILING KIT FOR AN INTERNAL COMBUSTION ENGINE

FIELD OF THE INVENTION

This invention relates to internal combustion engines and, more particularly to auxiliary oil pumping systems for pre-oiling of the internal combustion engine parts prior to ignition of the internal combustion engine cylinders.

BACKGROUND OF THE INVENTION

There has developed over the years a number of systems for pre-oiling the moving components including the cylinder walls, connecting rods, bearings, wrist pin bearings, etc., prior to starting of the engine and actual ignition of the fuel and air mixture to reduce wear on the parts. In the absence of such pre-oiling or auxiliary oiling systems, the engine must await ignition or turnover by the starting motor and operation of the main oil pump to effect oil pressurization, resulting in the initial starting of the engine with inadequate oil pressure to insure complete and adequate lubrication of the moving parts of the engine during initial start up. U.S. patents representative of such pre-oiling or auxiliary oiling systems are the following:

| U.S. Pat. No. | Inventor | Issue Date |
|---|---|---|
| 2,102,514 | Clarkson | Dec. 14, 1937 |
| 2,110,662 | Fisher | Mar. 8, 1938 |
| 2,747,564 | Wehling | May 29, 1956 |
| 2,755,787 | Butler et al | July 24, 1956 |
| 2,838,039 | Smith et al | June 10, 1958 |

While the systems of the above patents involve some components common to the pre-oiling kit of the present invention, the individual components are not commonly housed, there is no attempt to produce a unitary assembly which may be readily adapted to conventional internal combustion engines and placed either on the frame or to the side of the engine block, and which permits by the several electrical and oil lines projecting from a kit container ready connection of the system components to existing componentry of the internal combustion engine and to auxiliary elements facilitating the pre-oiling system.

Further, in the systems of known construction, there is no assurance that upon failure of the regular oiling system automatically as a result of loss of oil pressure, the auxiliary or pre-oiling pump is energized to maintain desired, adequate oil pressure for continued engine operation.

Further, in accordance with the present invention, it is an object of the present invention to provide a pre-oiling kit of simplified construction and simplified componentry and unitary construction which employs a special plug as replacement for the conventional drain plug and as a means for supplying oil pressure to the oil pressure operated switch within the kit container and delivering of oil to the oil gallery within the engine at a port opening into the engine block.

It is a further object of the present invention to provide an improved pre-oiling kit for an internal combustion engine in which primary and secondary oil strainers are provided within the kit container on the inlet and outlet sides of the pump for insuring cleanliness of the oil during extended engine operation.

It is a further object of the present invention to provide an improved pre-oiling kit for an internal combustion engine in which a manually operated switch located within the motor vehicle interior may override the oil pressure switch of the kit container to maintain energization of an electrical relay controlling the operation of the pre-oiling pump drive motor for further pressurization of the oil within the oil gallery beyond that normally provided by the pre-oiling kit under operation of the ignition switch, prior to ignition of the engine.

SUMMARY OF THE INVENTION

The present invention is directed to a pre-oiling kit for a motor vehicle or other internal combustion installation having a battery or other electrical power source, an ignition switch, and an internal combustion engine including an engine block and having an oil gallery, a port within the side of the block leading to the oil gallery and an oil sump underlying the block with a drain opening within the bottom of the sump. The kit comprises as a principal component a pre-oiling kit container for mounting exterior of the block with the container housing a pre-oiling pump having an inlet and an outlet, a pump electrical drive motor operatively coupled to the pump, a normally closed oil pressure switch and an electrical relay. A plurality of oil lines and electrical lines are provided to the kit and lead externally from the kit container including a first oil line connected to the pump inlet and a second oil line connected to the secondary oil strainer leading to the T connection on the block. A first electrical line leads from the container and connects the vehicle ignition switch in series with the battery, a coil of the relay and normally closed contact of the pressure operated switch. A second electrical line connects the normally open contacts of the relay and the pump electrical drive motor in series with the battery. A third electrical line is connected to a signal light mounted within the interior of the vehicle across the normally open contacts of the relay and in parallel with the pump drive motor for indicating energization of the pump drive motor and operation of the pre-oiling pump. A fourth electrical line may be connected to the first line between the relay coil and the normally closed contacts of the oil pressure switch and may carry a normally open manually operated switch for mounting to the vehicle dashboard and in parallel with the oil pressure switch such that the pre-oiling operation may be continued subsequent to the oil pressure operated switch de-energizing the pump drive motor to further pressurize the oil within the oil gallery prior to ignition of the engine. Means are provided for commonly connecting the end of the second oil line extending from the kit container to the block oil gallery port and the end of the first oil line to the sump oil drain opening, whereby initial operation of the ignition switch, prior to engine ignition, causes energization of the relay coil and energization of the pump electrical drive motor for pumping oil from the sump through the first line for pressurization of the same until sufficient oil pressure is sensed by the oil pressure switch through the second oil line and opening of the normally closed contacts of the oil pressure switch to terminate operation of the pre-oiling pump.

The means for commonly connecting the end of the second oil line to the block gallery port may comprise a nipple threaded to the port and to a T coupling at its base, with one end of the T cross portion connected to the end of said second oil line and the oil pressure gauge or switch, if the vehicle has a dashboard warning light, to the other end of the T. Further, a T-shaped replacement drain plug may be threaded to a drain opening of the sump by way of its base portion and may have one end of the T cross portion coupled to the end of the first oil line and bearing at the opposite end of the T cross portion a threaded end plug to permit selective draining of the oil from the sump without the necessity of disconnecting said first oil line therefrom.

DESCRIPTION OF THE PREFERRED EMBODIMENT

Figure 1:
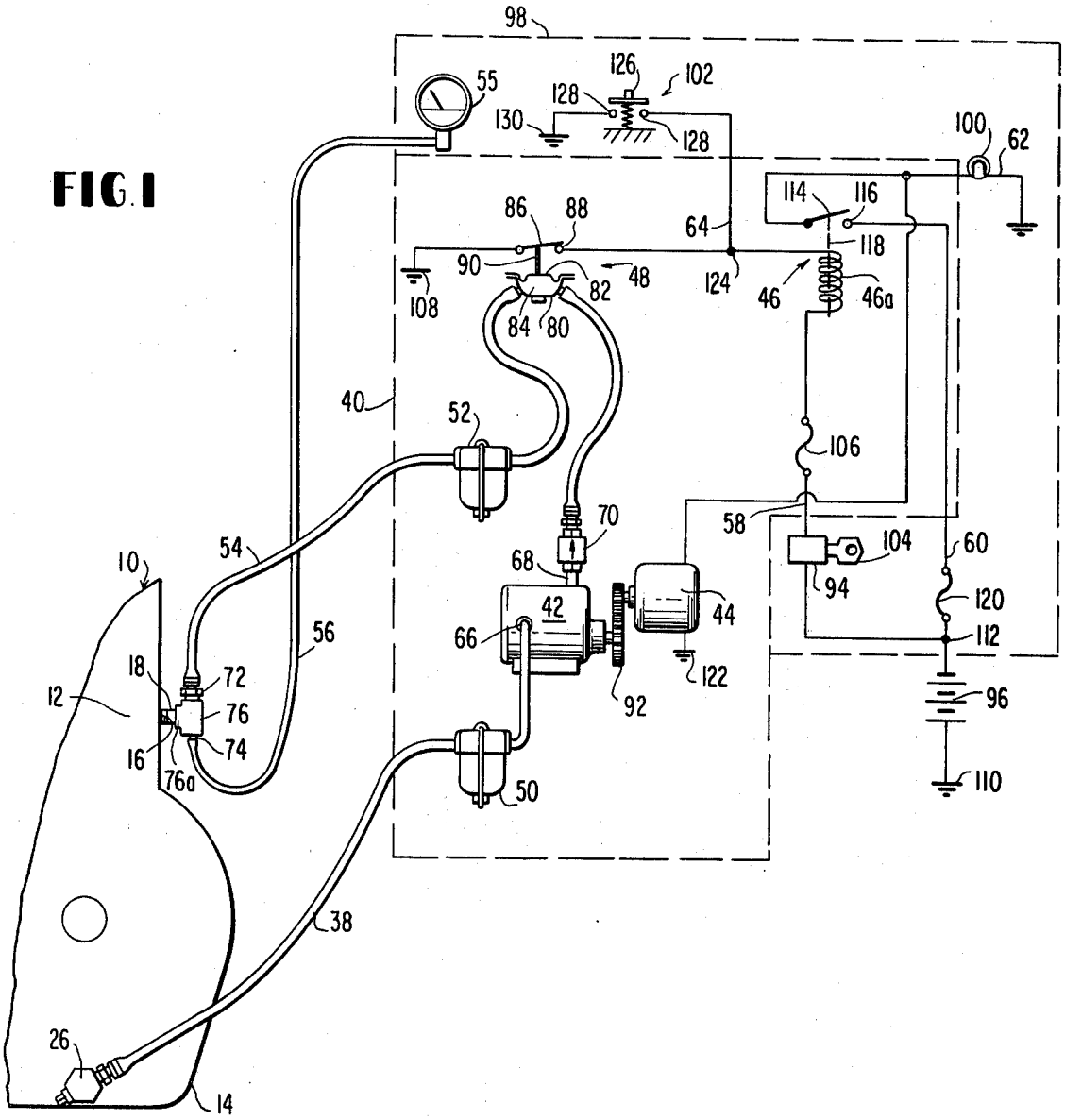
FIG. 1 is a partially schematic view of the improved pre-oiling kit of the present invention as applied to a motor vehicle including an internal combustion engine.

Referring to the figures, the partially schematic view includes the involved components of an internal combustion engine installation indicated generally at 10 including an engine block 12 and a sump 14 which underlies the block and which receives the oil after circulation through appropriate conduit or passage means within the engine block 12 via an oil gallery (not shown) carried by the block 12 but which opens to the exterior of the block 12 at gallery block port 16. A nipple 18 is threaded to the block 12 at port 16 and in fluid communication with the gallery. With respect to the oil sump 14, the bottom of the oil sump is provided with a standard boss 20, one end of which bears a tapped and threaded bore 22 receiving a threaded base 24 of a replacement "T" shaped (hex) drain plug indicated generally at 26, the base bearing a cross portion 28 whose transverse bore is tapped and threaded at both ends as at 30 and 32. The tapped and threaded bore portion 30 bears a threaded end plug 34 which may be removed for draining of the oil O from the oil sump 14 which accumulates within the same. Further, a connector 36 is threaded to the tapped and threaded bore portion 32 at the opposite end of the cross portion of the T-shaped replacement drain plug 26 and is appropriately configured to receive one end of a first oil line 38 which projects outwardly of the pre-oiling kit container or box, the outline of which is indicated in dotted lines generally at 40 and which may be mounted to the motor vehicle frame (not shown). In the illustrated embodiment, the container 40 is mounted to the inside of a vehicle dashboard as at 98. The container 40 houses certain elements of the kit and components of the pre-oiling system, including principally a pre-oiling oil pump 42, a pre-oiling pump electrical drive motor 44, a pre-oiling relay indicated generally at 46, an oil pressure switch indicated generally at 48 and primary and secondary oil strainers as at 50 and 52, respectively. In addition to the first oil line 38 which projects externally of the container 40, there is provided a second oil line 54, Further, in terms of the electrical circuit of the present invention, there projects outwardly of the container 40 of the kit a number of electrical lines or leads including a first electrical line 58, a second electrical line 60, a third electrical line 62 and a fourth electrical line 64.

With respect to the hydraulic circuit and the components of the kit, the pump 42 is provided with an inlet 66, the first oil line 38 terminating within the container 40 at the inlet 66 for delivering oil from the sump through strainer 50 to pump 42. The pump 42 further comprises an outlet 68 connected to the second oil line 54. Within the second oil line 54 at the pump outlet 68, there is provided a check valve 70 permitting oil flow from the pump to a pressure sensitive switch 48 through the secondary strainer and then to the gallery block port 16 but prevents oil under pressure upon termination of operation of the pump 42 from flowing in reverse from the oil gallery block port to the pump via oil line 54. A primary strainer 50 is incorporated within the first line 38 acting as the inlet line to the pre-oiling pump 42 and a secondary oil strainer 52 is provided within line 54 leading from the pump 42 to the oil gallery port 16. In that respect, the end of the second oil line 54 is connected through a threaded adapter 72 to one end of the cross portion of a T 76, the opposite end or side being connected to an oil pressure gauge 55 through line 56, oil gauge 55 being mounted to dashboard 98. The T is threaded to the end of the nipple 18 projecting form the gallery port 16. The oil pressure switch 48 which is fixedly mounted within the container 40 consists of a cup-shaped outer housing 80 and includes a metal diaphragm or the like at 82 defining with the housing 80 an oil cavity or chamber 84 which is pressurized to the extent of oil within the oil gallery portion of the block 12. The switch includes a movable contact 86 which is normally closed on a fixed contact 88 but which may be pivoted away from the fixed contact 88 by an actuator rod or the like 90 which is connected at one end to the movable switch contact 86 and at the opposite end to the center of the diaphragm 88. Thus, in the absence of oil pressure within chamber 84, the switch contacts are maintained closed but upon sufficient oil pressure within chamber 84, the diaphragm moves away from the casing 80 to open the contacts. The metal diaphragm 80 may be formed of spring metal so as to be self biased in switch closed position. The electrical drive motor 44 for pump 42 is of conventional construction, constituting in this case, a DC motor and is connected to the pump mechanically by a gear reduction means as at 92.

The kit makes use of certain electrical components which are already present and common to motor vehicles (a typical installation), such as an ignition switch 94 and a battery 96. Further, in the present invention, the kit is provided with two additional elements for mounting within the vehicle interior in the vicinity of the ignition switch 94 and preferably on the dashboard of the vehicle indicated by the box 98. These elements are a signal or indicator light 100 and a manually operated booster switch indicated generally at 102. The ignition switch 94 is shown with a key 104 which when turned to a first position, causes closure at that point, of contacts (not shown) within a portion of the electrical circuit defined by the first electrical line 58. Further, the ignition switch 94 obviously includes additional contacts responsive to further turning of key 104 so as to complete a circuit to the electrical starter motor and in a case where the engine 10 is a gasoline fueled internal combustion engine, the other components of the ignition circuit including the ignition coil (both not shown).

Either externally of the container 40 or internally of the same, line 58 carries an appropriate fuse such as a 5 amp fuse 106, line 58 being further connected in series with coil **46*a* of relay 46** and normally closed contacts 86–88 of the oil pressure switch 48. Line 58 is appropriately grounded at 108 to the side of the oil pressure switch 48 opposite the relay 46. Line 58 is appropriately connected to the side of the battery 96 opposite ground connection 110 as at 112, thereby the oil pressure switch contacts, the relay coil, and the ignition switch are in series and across battery 96. Relay 46 is provided with normally open contacts including a movable contact 114 and a fixed contact 116. The movable contact 114 is controlled by an appropriate armature indicated by dotted line 118. A spring or other biasing means (not shown) maintains the switch contacts 114 and 116 open for the relay 46 absent energization of relay coil 46*a*. In that regard, the second electrical line 60 is connected to battery 96 through a 20 amp fuse 120 and connects contacts 114 and 116 of the relay 46 to the electrical drive motor 44, the motor 44 being grounded at 122. Thus, in response to closure of the normally open contacts of the relay 46, the motor is energized for a period determined by the energization of the relay coil 46*a*. Further, the third electrical line which projects from the container 40 as at 62, is connected to a signal light 100 borne by the vehicle dashboard 98, the signal light 100 being in parallel with the electric drive motor 44 and being energized in response to energization of that motor, thus indicating the existence of pre-oil pressurization of the gallery. Obviously, upon de-energization of the relay coil 46*a*, not only is the energization of the pump motor 44 terminated, but simultaneously the signal light is extinguished. This occurs under normal operating procedures in response to oil pressurization of chamber 84, causing the normally closed switch contacts of the oil pressure switch 48 to open, de-energizing the relay coil 46*a*, reopening the normally open contacts 114 and 116 of relay 46 and de-energization of both the pre-oiling pump drive motor 44 and the light 100 signalling such operation.

Conventionally in operation, therefore, by turning of the key 104 to a first position within the ignition switch 94, the pre-oiling pump 42 is operated to the extent that the oil pressure within line 54 and increases as well as that within the oil gallery by way of the oil gallery block port 16. When proper pressurization for pre-oiling is achieved, the opening of the normally closed contacts 86 and 88 of the oil pressure switch 48 automatically results in de-energization of the pump drive motor 44 and a termination of the energization of signal light 100 indicating to the vehicle operator that pre-oiling has been achieved and that further turning of the key 104 may be had to effect ignition of the internal combustion engine.

The present system also offers the advantage of providing additional extra pressure of the oil by continued operation of the pre-oiling pump 42 after initial pressurization opens the pump drive circuit through the oil pressure switch 48. In that regard, a fourth electrical line 64 protruding from the container 40 and connected to the first electrical line 58 at a point 124 intermediate of the relay coil 46*a* and the contacts 86–88 of the oil pressure switch extends to the dashboard 98 and is connected to the booster switch 102. The booster switch 102 comprises a depressible dash booster button 126 which is spring biased away from but may be closed upon a pair of spaced, fixed contacts 128 within the fourth electrical line 64, with that line being grounded as at 130. Thus, the booster switch 102 is connected in parallel with the oil pressure switch 48 and commonly in series with relay coil 46*a*, such that upon depression of the push button 126, the relay coil 46*a* is energized through battery 96 and the ignition switch 94 (prior to the turning of key 104 to full ignition position) and permitting the pump drive motor 44 to be energized and operated irrespective of the oil pressure within chamber 84 of the oil pressure switch 48.

Figure 2:
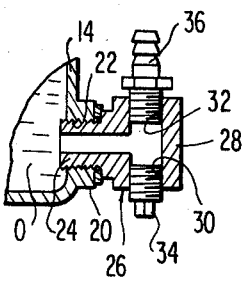
FIG. 2 is a sectional view of the replacement drain plug coupled to the sump of the internal combustion engine of FIG. 1 taken about line II—II.

From the above, it may be seen that by purchase of the kit including the two oil lines 38 and 54 and the electrical lines 58, 60, 62 and 64, it is necessary only to cut all of these oil and electrical lines to a proper length, connect the electrical lead or line 58 to the ignition switch or to the ignition switch side of the ignition coil (provided there is no resistance in series with it, in which case it should be attached either to the ignition switch or to the ignition switch side of the voltage regulator), but keeping in mind that it should not be attached to the battery side of the ignition switch. The electrical line 60 is required to be connected with the 20 amp fuse of equivalent to either the starter solenoid or the positive battery lead, in this case the positive battery lead as at 112. Further, it is necessary to install the signal light as at 100 in some convenient and obvious location on dashboard 98 and to assure grounding of the signal light as at 101. The third electrical line 64 is required to be connected to one side of the booster switch 102 at one fixed contact 128, while the opposite side via the opposite fixed contact 128 is grounded as at 130. The oil line 38 is attached at its outboard end to the replacement drain plug by way of connector or fitting 36, FIG. 2, with the plug 26 replacing the conventional drain plug within one end of the oil sump or oil pan 14. Further, the oil line 54 is connected to one end or one side of the T-shaped plug 76, the opposite end or side having connected thereto the oil pressure gauge 55 and, of course, the base of the T-shaped plug being connected to the engine block at the oil gallery port 16 by way of an appropriate nipple or other appropriate fitting as at 18.

It is obvious that a person of ordinary skill rather than a skilled mechanic may achieve all of these connections, particularly by following appropriate instructions supplied with the kit. Further, from the above, it is obvious that by turning of the ignition switch to its first position to cause energization of the pump drive motor 44, the operator is cognizant of pre-oiling oil pressure of the oil gallery as a result of the energization of the signal light 100 which light will be on for some seconds until the oil pressure is sufficiently high within the oil gallery as is sensed by the oil pressure switch 48. Switch 48 automatically disconnects the circuit through relay 46 to the pump drive motor 44 and to light 100. With the oil pressure up, oil in sufficient quantity and pressure is supplied to the bearings and other vital moving parts. In subsequent starts, once the pre-oiling pump 68 is primed, the signal light 100 will stay on for a shorter period of time until it starts pulsating (an indication that the pump is stopping and re-starting as the oil is drained from the oil gallery). The driver then turns the key 104 to the starter position to start the engine as in normal operation. Under normal operation, the dash signal light 100 should go out indicating that the pre-oiling system is under standby condition and the regular engine oiling system is in operation. At starting time, if the engine stalls, the signal light may not come on, which indicates that the pressure at the oil gallerg is still in excess of that determined by the oil pressure switch 48. The oil pressure for example may be pre-oil pump pressured to approximately 7 pounds, and if the pressure drops below 7 pounds, not only will the signal light 100 come on, but obviously, the auxiliary or pre-oiling pump 42 is under operation and supplies oil under pressure to the gallery.

Further, since the oil pressure gauge (not shown) senses the oil pressure available to the gallery, it is obvious that if the operator needs to bring the oil pressure higher than that provided by the pump 42 with automatic cut-off by the oil pressure switch 48, the manual depression of the booster button 126 only for a few seconds will result in a higher pressurization prior to ignition of the engine and the operator simply observes the higher oil pressure at the oil gauge. The kit may additionally comprise strapping and stove bolts, lock washers, oil line connectors or the like, to facilitate the adaptation of the kit to the various types of motor vehicles. In most motor vehicles, the container 40 may be placed under the hood or attached to the frame but not fixed to the engine block 12. It is obvious that for best operation the kit container and its components should be kept away from the heat of the engine, from wheel spray, while the electrical and oil lines should be kept away from the hot exhaust pipe, etc.

While the invention has been paticularly shown and described with reference to a preferred embodiment thereof, it will be understood by those skilled in the art that various changes in form and details may be made therein without departing from the spirit and scope of the invention.

What is claimed is:

1. A pre-oiling kit for an installation including a battery, an ignition switch, an internal combustion engine including an engine block having a port in the block leading to an oil gallery and an oil sump underlying the block and having a drain opening within the bottom of the sump, said kit comprising:

a pre-oiling kit container for mounting exterior of said engine block;

said container housing a pre-oiling pump having an inlet and an outlet;

a pump electrical drive motor operatively coupled to said pump;

a normally closed contact oil pressure switch;

an electrical relay including a relay coil and normally open contacts controlled by said coil;

a plurality of oil lines and electrical lines carried by said container and having ends extending externally from said container including a first oil line connected to the pump inlet and a second oil line connected to the pump outlet, and to the oil pressure operated switch, a first electrical line connecting said vehicle ignition switch in series with said battery and the relay coil and said normally closed contacts of said pressure operated switch, a second electrical line connecting the normally open contacts of said relay and the pump electrical drive motor in series with said battery, a third electrical line connecting a signal light mounted within the interior of said vehicle across the normally open contacts of the relay and in parallel with said pump drive motor for indicating energization of the pump drive motor and operation of the pre-oiling pump; and means for commonly connecting the ends of said second oil line extending from said kit container to said oil gallery block port and the end of said first oil line extending from said kit container to the sump oil drain opening, whereby initial operation of the ignition switch closes a circuit including said first electrical line prior to engine ignition to cause energization of said relay coil and energization of said pump electrical drive motor and said indicator light through said second line for pumping oil from said sump to said first and second lines for pressurization of the same until sufficient oil pressure effects opening of the normally closed contacts of the oil pressure switch within said first electrical line to terminate operation of the pre-oiling pump and to extinguish said light.

2. The pre-oiling kit as claimed in claim 1, wherein said means for commonly connecting the ends of said second oil line to the block gallery port comprises a T-shaped plug having its base connected to said port and bearing a bored cross portion connected at respective ends to said second oil line and an oil pressure gauge, respectively, and said replacement drain plug comprises a T-shaped plug including a base connected to said drain opening of the sump and bearing a cross portion open bore having one end coupled to the end of said first oil line and its opposite end bearing a threaded end plug to permit selective draining of the oil from said sump without the necessity of disconnecting the first oil line therefrom.

3. The pre-oiling kit as claimed in claim 1, further comprising a normally open manually operated switch connected in series with said relay coil and in parallel with said oil pressure operated switch contacts such that the closure of the manually operated switch subsequent to oil pressure opening of the normally closed contacts of the oil pressure switch and de-energization of the relay coil and said electrical pump drive motor causes the relay coil to be re-energized and closing the normally open relay contacts and energization of the pump electrical drive motor for further pressurization of the oil leading from said pre-oil pump to said block gallery port.

4. The pre-oiling kit as claimed in claim 2, further comprising a normally open manually operated switch connected in series with said relay coil and in parallel with said oil pressure operated switch contacts such that the closure of the manually operated switch subsequent to oil pressure opening of the normally closed contacts of the oil perssure switch and de-energization of the relay coil and said electrical pump drive motor causes the relay coil to be re-energized and closing of the normally open relay contacts and energization of the pump electrical drive motor for further pressurization of the oil leading from said pre-oil pump to said block gallery port.

* * * * *